US008272782B2

(12) United States Patent
Chum

(10) Patent No.: US 8,272,782 B2
(45) Date of Patent: Sep. 25, 2012

(54) PLASTIC FILM BAG TO INCREASE LOAD BEARING CAPACITY

(76) Inventor: Hon Sing Chum, Ma On Shan (HK)

( * ) Notice: Subject to any disclaimer, the term of this patent is extended or adjusted under 35 U.S.C. 154(b) by 323 days.

(21) Appl. No.: 12/701,557

(22) Filed: Feb. 6, 2010

(65) Prior Publication Data

US 2011/0097015 A1 Apr. 28, 2011

(30) Foreign Application Priority Data

Oct. 27, 2009 (CN) ..... 2009 1 0110343

(51) Int. Cl.

| | |
|---|---|
| ***B65D 33/10*** | (2006.01) |
| ***B65D 30/00*** | (2006.01) |
| ***B65D 30/20*** | (2006.01) |
| ***B65D 30/10*** | (2006.01) |

(52) U.S. Cl. ..... 383/8; 383/107; 383/120; 383/121; 383/903

(58) Field of Classification Search ..... 383/8, 120, 383/107, 903, 121

See application file for complete search history.

(56) References Cited

U.S. PATENT DOCUMENTS

| | | | | |
|---|---|---|---|---|
| 3,326,449 | A * | 6/1967 | Dickson | 383/94 |
| 3,762,542 | A * | 10/1973 | Grimes | 206/525 |
| 3,961,743 | A * | 6/1976 | Hollowell | 383/7 |
| 4,345,712 | A * | 8/1982 | Gim | 383/7 |
| 4,464,157 | A * | 8/1984 | Benoit et al. | 493/211 |
| 4,529,090 | A * | 7/1985 | Pilon | 206/554 |
| 4,588,392 | A * | 5/1986 | Maddock | 493/200 |
| 4,613,988 | A * | 9/1986 | Maddock | 383/8 |
| 4,812,055 | A * | 3/1989 | Prader et al. | 383/119 |
| 4,838,977 | A * | 6/1989 | Ebmeyer et al. | 156/252 |
| 2004/0141665 | A1 * | 7/2004 | Yung | 383/121 |

FOREIGN PATENT DOCUMENTS

| | | | |
|---|---|---|---|
| DE | 3829056 | C1 * | 11/1989 |
| GB | 2203127 | A * | 10/1988 |
| JP | 2002173149 | A * | 6/2002 |
| JP | 2003312684 | A * | 11/2003 |

* cited by examiner

*Primary Examiner* — Jes F Pascua

(74) *Attorney, Agent, or Firm* — Law Office of Steven R. Olsen, PLLC; Steven R. Olsen

(57) ABSTRACT

A plastic bag includes a plastic bag body with 4-layer gussets on two sides and 2-layer film in the middle. The plastic bag body is provided with a curved hot-seal line near a bottom edge of the bag body. The curved hot seal line turns upward on two sides and is recessed in the middle. Since plastic bags with the structure referred to herein eliminate a stress concentration at a bottom hot-seal location, such plastic bags have increased load-bearing capacity.

2 Claims, 1 Drawing Sheet

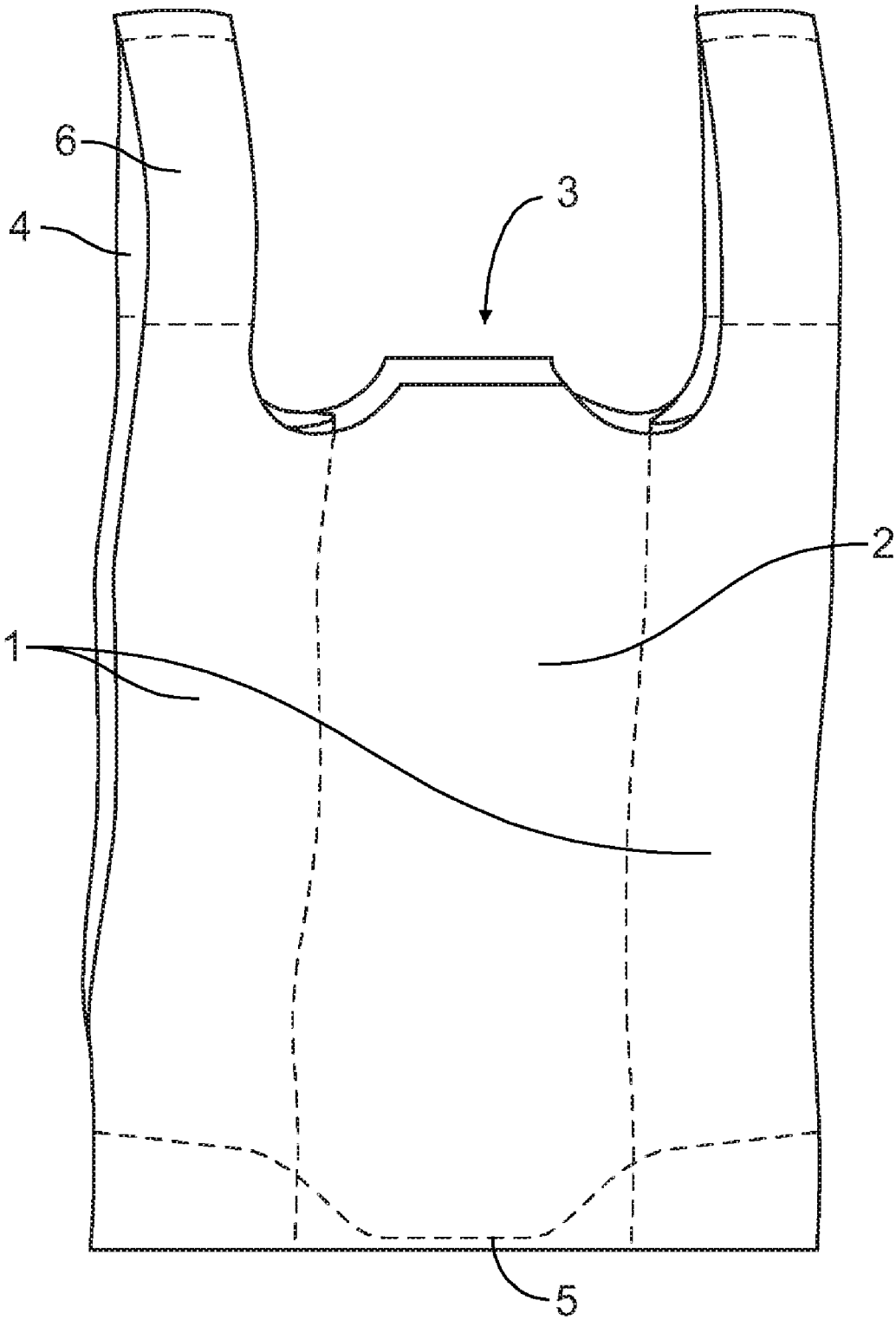
6
4
3
2
1
5

PLASTIC FILM BAG TO INCREASE LOAD BEARING CAPACITY

This application claims the benefit of Chinese patent application no. 200910110343.2, filed Oct. 27, 2009, the contents of which are hereby incorporated herein by reference in their entirety.

FIELD OF TECHNOLOGY

The present invention relates to a plastic film bag, and more particularly, to a plastic film bag that can increase load-bearing capacity.

BACKGROUND OF TECHNOLOGY

Plastic bags are extensively used to package goods. Plastic bags are typically manufactured from a tube of blown plastic film. The tube of plastic film can be folded inward on the sides to form 4-layer gussets. The middle of each bag has only 2-layers of plastic film. Tubes can be cut to a predetermined length, and an electric-heating iron may be used to seal (or weld) a bottom edge of the tube to form the bag body. Plastic bags manufactured using this method may be of various configurations, including flat-mouth bags with or without carrying straps, and vest-style bags with carrying straps. Vest bags are so named because they resemble a garment that is worn on the upper body of a person. Plastic bags of this structure can facilitate storage and carrying of various types of goods. However, they have poor load-bearing capacity. The reason is that the 4-layer gusseted sides of the plastic bag are directly hot-sealed to the intermediate 2-layer film near a bottom edge of the bag. The intersection of 4-layer film and 2-layer film becomes a stress concentration and a point of frequent failure. Breakage at the bottom affects the load-bearing capacity of the plastic bags and may also lead to leakage.

SUMMARY OF THE INVENTION

One technical issue to be addressed in the present invention is the stress concentration near the bottom edge of plastic bags. Solving this problem will increase the load-bearing capacity of plastic bags.

Plastic bags typically include a plastic bag body with 4-layer side gussets. Gussets may be formed by folding the bag body inward on two opposing sides. The bag body has 2-layer film in the middle portion of the bag body (i.e., between the gusseted sides). A first improvement over conventional bags is that the plastic bag body is provided with a curved hot-seal line near a bottom edge of the plastic bag. The curved hot seal line turns upward on two sides and is recessed in the middle. The interior of the resulting plastic bag is deepest in the middle.

The plastic bag body could be a flat-mouth bag body or a vest bag body with carrying straps attached to an upper portion of the bag body. The carrying straps may also be gusseted so that a front portion of each carrying strap includes 2 layers of folded film and a rear portion of each carrying strap includes an additional 2 layers of folded film. A second improvement over conventional bags is that film layers in each carrying strap can be selectively laminated to produce 2 laminated front layers of plastic film and 2 laminated rear layers of plastic film. In use, each strap is a loop of 2-layer laminated plastic film. The lamination may be performed using thermoplastic adhesive.

The first design improvement changes the shape of the hot-sealed line at the bottom of plastic bags. A curved hot-seal line near the bottom of the bag body is used in place of a conventional straight hot seal line. This relieves the stress concentration arising from abrupt changes where 4-layer plastic film and 2-layer plastic film connect. Removing this stress concentration eliminates potential breakage near a bottom edge of the bag. The improved bag may also include the second design improvement, which is carrying straps that use 2-layer laminated film. Lamination can increase the strength of the carrying straps and eliminate breaking and tearing defects associated with carrying straps.

The present invention can increase the load-bearing capacity of plastic bags compared with other plastic bags made from film of similar specifications and thickness. Since plastic bags with the structure referred to herein eliminate a stress concentration near the bottom of plastic bags, load-bearing capacity is increased and breakage is decreased. Laminated carrying straps may also increase strength and eliminate breaking and tearing defects associated with carrying straps.

Embodiments of the invention are described in more detail with reference to the drawing and discussion of a preferred embodiment.

DESCRIPTION OF ENCLOSED DRAWINGS

FIG. 1 is a structural diagram of a plastic bag with increased load-bearing capacity, according to an embodiment of the invention.

PREFERRED EMBODIMENTS

FIG. 1 illustrates a vest-style plastic bag with carrying straps that increases load-bearing capacity. The illustrated vest-style plastic bag includes some structure seen in conventional vest-style plastic bags with carrying straps, including 4-layer side gussets (1) on two sides, and a plastic bag body (3) having two-layer film (2) in the middle. Two carrying straps are formed at the upper section of the plastic bag body (3). Each of the two carrying straps includes 4 layers of plastic film as a consequence of a gusseting operation. The 4 layers of plastic film in each strap are joined at a weld line near a top edge of each carrying strap.

The illustrated bag includes two improvements over a conventional vest-style bag with carrying straps. First, the plastic bag body (3) is provided with a curved hot-seal line (5) near a bottom edge of the bag. The hot seal line (5) turns upward on two side portions and is recessed in a middle portion of the hot seal line (5). The interior space of the resulting bag is therefore deepest in the middle of the bag body (3).

Secondly, film layers of the carrying straps may be selectively laminated so that a front portion (6) has 2 laminated layers and a rear portion (4) has 2 laminated layers. Accordingly, each carrying strap is effectively a loop of 2-ply laminated plastic film.

The above summary and discussion of a preferred embodiment describe the present invention. However, such description is not intended to restrict or limit the scope of the invention. Ordinary technicians involved in the technical sector of the present invention may extend similar embodiments or conceive other embodiments within the conception of the present invention and such embodiments shall be included within the scope of patent protection as specified in the claims.

I claim:

1. A plastic bag comprising a bag body, the bag body having two 4-layer side gussets and a 2-layer middle portion disposed between the two 4-layer side gussets, the bag body having a curved hot-seal line near a bottom edge of the bag body, the curved hot seal line joining together 4 layers in each of the two 4-layer side gussets, the curved hot seal line joining together 2 layers of the 2-layer middle portion, the curved hot-seal line being turned upward at two side portions of the curved hot seal line and recessed in a central part of the 2-layer middle portion, the central part forming a deepest interior portion of the bag body.

2. The plastic bag of claim 1, wherein the bag body includes a flat-mouth opening at a top edge of the bag body.

* * * * *